US005450968A

United States Patent [19]

Bustos

[11] Patent Number: 5,450,968

[45] Date of Patent: Sep. 19, 1995

[54] SHELVING SYSTEM WITH ADJUSTABLE WIDTH MERCHANDISE CHANNELS

[75] Inventor: Rafael T. Bustos, Alpharetta, Ga.

[73] Assignee: L&P Property Management Company, Chicago, Ill.

[21] Appl. No.: 234,230

[22] Filed: Apr. 28, 1994

[51] Int. Cl.[6] ..... A47F 5/00

[52] U.S. Cl. ..... 211/59.2; 108/108; 211/184; 211/187

[58] Field of Search ..... 211/59.2, 184, 74, 187; 108/107, 108, 109

[56] References Cited

U.S. PATENT DOCUMENTS

| | | | |
|---|---|---|---|
| Re. 33,515 | 1/1991 | Fershko et al. . | |
| 1,711,329 | 4/1929 | Short . | |
| 2,623,641 | 12/1952 | Shidd | 211/59.2 |
| 2,730,825 | 1/1956 | Wilds | 211/59.2 X |
| 3,300,057 | 1/1967 | Wheaton . | |
| 4,346,806 | 8/1982 | Bustos . | |
| 4,383,614 | 5/1983 | Miller | 211/59.2 |
| 4,461,388 | 7/1984 | Bustos . | |
| 4,496,037 | 1/1985 | Spamer . | |
| 4,519,508 | 5/1985 | Gullet et al. . | |
| 4,593,823 | 6/1986 | Fershko et al. . | |
| 4,685,574 | 8/1987 | Young et al. . | |
| 4,801,025 | 1/1989 | Flum et al. . | |
| 4,809,855 | 3/1989 | Bustos . | |
| 4,901,869 | 2/1990 | Hawkinson et al. . | |
| 4,958,739 | 9/1990 | Spamer . | |
| 4,997,094 | 3/1991 | Spamer et al. . | |
| 5,022,535 | 6/1991 | Spamer | 211/187 X |
| 5,050,748 | 9/1991 | Taub . | |
| 5,088,607 | 2/1992 | Risafi et al. . | |
| 5,097,962 | 3/1992 | Eklof et al. . | |
| 5,119,945 | 6/1992 | Wiggins . | |
| 5,160,051 | 11/1992 | Bustos . | |
| 5,199,584 | 4/1993 | Fowler et al. . | |

*Primary Examiner*—Robert W. Gibson, Jr.
*Attorney, Agent, or Firm*—Wood, Herron & Evans

[57] ABSTRACT

A gravity feed merchandising display system includes a plurality of adjustable and variable width channels to support and organize variously sized merchandise items thereon. The channels are formed by a pair of adjacent slats which extend between a front crossbar and a rear crossbar in the shelving system. Each crossbar includes a plurality of spaced slots to which a tab projecting from each slat can be engaged and disengaged. By adjusting the width between adjacent slats, various sized merchandise items can be supported and displayed in a gravity feed configuration on a shelf of this system. As a result, a retailer has added versatility in designing a merchandising display system and more efficient use of available shelf space.

19 Claims, 1 Drawing Sheet

SHELVING SYSTEM WITH ADJUSTABLE WIDTH MERCHANDISE CHANNELS

BACKGROUND OF THE INVENTION

This invention relates to display racks, and more particularly to an improved gondola display rack of the gravity feed type.

This invention is particularly adapted, but not necessarily limited to, use in the merchandising of beverages as for example, soft drinks and beer. Gondola display racks, constructed primarily of sheet metal, are commonly used in grocery stores, supermarkets, and the like for the display and merchandising of beverages. Beverages are sold in bottles and containers of various sizes, smaller bottles being commonly packaged in cartons, and the larger multi-liter sizes being generally in the form of individual bottles. The sizes of the small bottles may vary, and the relative proportion of cartons to large bottles in a particular display also varies, depending on the demand experienced by a particular vendor. For these reasons, gondola display racks should be adjustable for optimum usage of available space.

A typical gondola display rack comprises a sheet metal base and a vertical upright extending upwardly from the rear of the base. The bottles and beverage cartons are normally arranged on shelves supported from the upright and cantilevered over the base. The shelves are typically in a gravity feed orientation in which a front edge of the shelf is vertically lower than a rear edge thereof. As a result, merchandise positioned on the shelf will tend to advance by gravity toward the front edge thereof. The gravity feed of merchandise toward the front edge of the shelf maintains the product in a conveniently accessible location for the customer on the shelf.

A common problem characteristic of gondola displays is that there is very little flexibility in the mix of products which may be displayed on a single shelf. To organize and promote the gravity feed advance of the merchandise on the shelves, partitions or dividers are commonly employed which extend longitudinally on the shelf between the front edge and the back edge. The partitions or dividers separate the merchandise into columns so that when the leading item in a column of merchandise is removed, the remaining items in that column advance forwardly thereby replacing the removed item without interference from adjacent columns of merchandise. However, the channel widths that arrange the merchandise into columns are typically set by the shelf manufacturer. The dividers are often permanently secured or formed into the shelf. If so fixed, the retailer or vendor has very little flexibility in designing a merchandising display or providing a mix of variously sized merchandise items on a given shelf.

One alternative to the problems associated with dividers permanently secured to or formed with the gravity feed shelf is the use of removable wire racks secured atop the shelf. These racks are typically constructed so as to allow rows of items to be displayed along the depth of the gondola shelf. The rack is supported by the shelf. The number of rows of items displayed on any particular shelf depends on the shelf width and the width of the product. The rows defined by the rack have heretofore often been of a width dimension creating a rather loose fit of displayed product within the divider rack channels because the standard width shelf often results in a portion of the shelf being wasted.

While a loose fit is desirable in order to allow articles to freely slide over an inclined shelf surface toward the front edge thereof, usable shelf space is foregone to the extent that the gondola shelf channel widths are fixed and set by the manufacturer. Display racks of this type for use on gravity feed gondola shelves are disclosed in U.S. Pat. No. 5,119,945 assigned to the assignee of this invention. However, these wire racks still have fixed width columns for the merchandise. The vendor is still restricted in configuring or re-configuring a display depending upon the channel widths fixed by the manufacturer of the rack.

Another approach for arranging merchandise on a gravity feed shelf is disclosed in U.S. Pat. No. 5,199,584 directed to a variable shelf organizer. This patent discloses a substantially flat product supporting floor member having a plurality of channel-like dovetail slots formed between upright support members on the floor member. Dividers having inverted T-shaped lower ends are designed to selectively engage and disengage the dovetail slots to form product guide channels between adjacent dividers.

Problems associated with the shelf organizer disclosed in U.S. Pat. No. 5,199,584 include the relative expansive tooling and involved manufacturing of the floor members required to form the intricate channel-like spaces in the floor member and the difficulty in reconfiguring the product channel widths by sliding the dividers from the channel-like spaces and then re-inserting them as desired. Furthermore, the floor member are each of a limited width and multiple floor members must be joined side-by-side to cover widths larger than a single floor member. However, a shelf which is not equal in width to an integral number floor members still has unused, but available, merchandising space thereon.

SUMMARY Of THE INVENTION

It has been a primary objective of this invention to provide an improved gondola display rack which is amiable to greater flexibility of product mix than prior art gondola displays.

Still another objective of this invention has been to provide an improved gravity feed merchandising system which has an improved space to sales ratio relative to prior gravity feed shelving systems and which has greater product display capacity and flexibility than prior gravity feed merchandising systems.

A further objective has been to provide such a system which is easily and inexpensively manufactured and does not require complicated or difficult procedures when reconfiguring as needed.

These and other objectives of the invention have been attained by a gravity feed shelving system having variable width channels for displaying merchandise in columns on the shelf. This invention is described herein and shown in the appended drawings with reference to a gondola-type display rack. However, the invention is not limited to the gondola display rack environment and is applicable to other display rack types. For example, this invention is also useful with a warehouse style merchandising system or rack-type shelving system having a plurality of forward and rear posts supporting the shelves as shown in U.S. Pat. No. 5,160,051, assigned to the assignee of this invention. The disclosure of that patent is hereby incorporated by reference.

A gondola display rack made in accordance with this invention comprises a sheet metal base mounted on the floor and a vertical rear support extending vertically upward from the rear of the base. Mounted above the fixed base are multiple shelves adjustably mounted upon the upright rear support and cantilevered over the base. Each of the shelves has a forwardly and downwardly sloping top surface with a forward edge being lower than a rear edge. The downwardly sloping shelves are operative to gravity feed products supported thereon toward the front edge of the shelf. The frame preferably supports an array of horizontally aligned and vertically stacked shelves, each of which slopes downwardly and forwardly.

Each shelf according to this invention has both a front and a rear crossbar proximate a front and a rear edge of the shelf, respectively. Each crossbar has a generally L-shaped configuration with the addition of a flange depending downwardly at an angle from the top edge of the generally vertical leg of the L-shaped crossbar. A plurality of generally equally spaced and parallel slots are cut or formed into the top edge of each crossbar at the intersection of the vertical leg and the downwardly depending flange. In general, the slots in the front crossbar are aligned longitudinally with the slots in the rear crossbar.

A number of slats are supported by and extend between the front and rear crossbars on each shelf. Preferably, each slat is in either an L-shape or an inverted T-shape configuration and has a tab or hook-like projection on both the forward and rear ends proximate the upper edge of a generally vertical leg of the slat. The slats are supported by the crossbars with the tab at the front and rear end of each slat inserted into a slot in the front and rear crossbar, respectively. With the tabs inserted into the slots on the crossbars, the generally horizontal leg of the slat rests upon and is supported by the generally horizontal leg of each crossbar.

Each shelf can accommodate a plurality of crossbars. A pair of adjacent crossbars cooperate to form a channel with the horizontal leg of each adjacent crossbar being directed inwardly toward the other slat. Merchandise items such as soft drink bottles, cartons, or other containers are supported within the channel by the adjacent slats atop the lower horizontal legs of the adjacent slats. The merchandise in the channel is formed into a column for the gravity feed dispensing thereof.

Advantageously, the width of each channel is selectively adjustable by disengaging at least one of the adjacent slats from the front and rear crossbar and repositioning it at the desired spacing by inserting the tabs on the slat in the appropriate slots on the crossbars. As a result, a maximum number of varying width merchandising columns can be arranged on a single individual gravity feed shelf. In addition, the width of each channel is selectively adjustable to accommodate the varying sizes of merchandise items and enables the retailer to selectively configure the display rack as needed.

In addition, a bumper wire is provided at the front edge of each channel to prevent the merchandise in the gravity feed mode from sliding off of the front edge of the shelf. The bumper wire is a generally inverted U-shaped member having a pair of depending legs. Each leg is inserted into a hole in the generally vertical leg of one of the adjacent slats forming a channel.

BRIEF DESCRIPTION OF THE DRAWINGS

The objectives and features of this invention will become more readily apparent from the following detailed description taken in conjunction with the accompanying drawings in which.

DETAILED DESCRIPTION OF THE INVENTION

Figure 1:
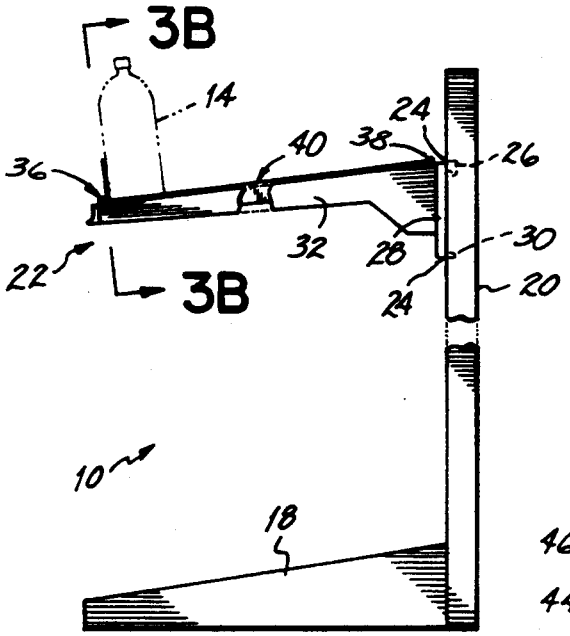
FIG. 1 is a side elevational view of a gondola display rack according to this invention.

A gondola-type shelving system or display rack 10 according to this invention is shown in FIG. 1. The shelving system 10 is for displaying packages of beverage products 12 and/or individual bottles 14 or cans 16 in stores or retail establishments (FIG. 2).

The gondola display rack 10 shown in FIG. 1 comprises a wedge-shaped base 18 mounted upon the floor of a store or retail establishment. Attached at a rear edge of the base is an upwardly extending rear support frame 20 to which a gravity feed shelf 22 is attached in a cantilever configuration. A single gravity feed shelf 22 is shown in FIG. 1, however, it will be appreciated by one of ordinary skill in the art that the display rack of this invention can accommodate a plurality of cantilever supported shelves.

The rear support frame 20 has a plurality of spaced vertically arranged holes 24 adapted to receive hook-shaped tabs 26 on shelf mounting brackets 28 for removably securing the shelves 22 to the rear support frame 20. Each shelf mounting bracket 28 includes the upper hook-shaped tab 26 and a lower tab 30, each of which is inserted into holes 24 in the rear support frame 20. A shelf side bracket 32 is attached to the mounting bracket 28 at each lateral edge of the shelf 22 and extends outwardly from the rear support frame 20 to overhang the base 18. A price and information channel 34 is secured to the terminal end of each side bracket 32 at the front edge of the shelf 22 to indicate the price or other relevant information for the merchandise supported on the shelf 22 as is well known in the art.

Figure 2:
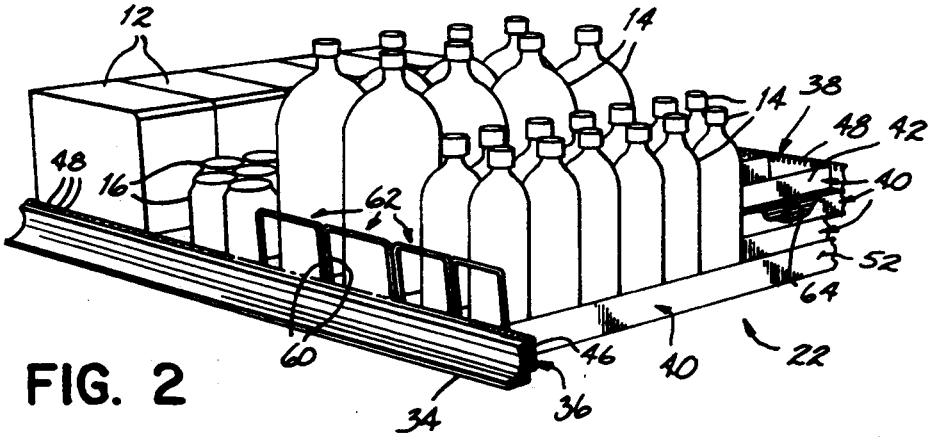
FIG. 2 is a perspective view of a shelf incorporating the adjustable width channels for arranging merchandise into columns.

With reference to FIG. 2, each shelf 22 includes a front crossbar 36 and a rear crossbar 38. Extending between and removably attached to the front and rear crossbars 36, 38 are a plurality of slats 40. A pair of adjacent slats 40 on each shelf cooperate to form a channel 42 in order to separate the merchandise on the shelf 22 into a column. The advantage of separating the merchandise on the shelf 22 into columns is to promote the orderly advance of the items in a column toward the front edge thereof in the gravity feed configuration. When the leading item in the column is removed, the remaining items in that column advance forwardly by gravity as a result of the inclined downwardly sloping orientation of the shelf 22. Arranging the merchandise into columns inhibits other merchandise on the shelf 22 from impeding or interrupting the gravity feed advance of the merchandise in other columns on the shelf.

Figure 3A:
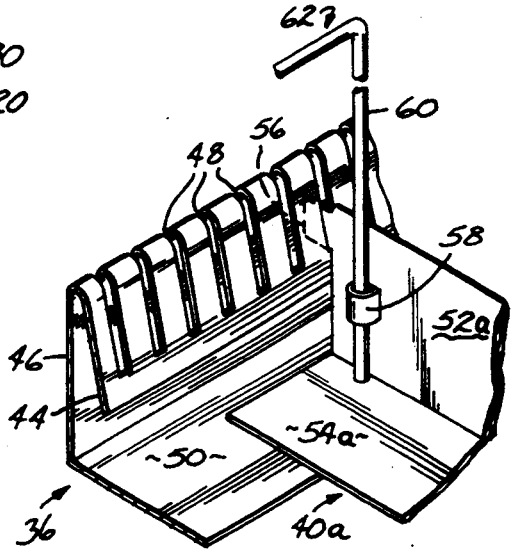
FIG. 3A is an enlarged broken away perspective view of a front crossbar, L-shaped slat, and bumper wire of this invention.

The front cross bar 36 as shown in FIG. 3A, is a generally L-shaped angle iron having a flange 44 attached or formed onto an upper edge of a generally vertical leg 46 of the crossbar 36. The flange 44 depends from the upper edge of the crossbar 36 downwardly to form an acute angle with respect to the vertical leg 46.

A plurality of generally parallel and equally spaced apertures or slots 48 are cut or formed into the flange 44 and the vertical leg 46 of the crossbar 36. The slots 48 are open at the upper edge of the crossbar 36 and generally rectangular. The detailed configuration of the preferred embodiment of the crossbar is shown in FIG. 3A with reference to the front crossbar 36; however, it will be appreciated by one of ordinary skill in the art that a similarly configured, reversely oriented crossbar configuration is required for the rear crossbar 38. A generally horizontal lower leg 50 of the crossbar 36 extends perpendicularly from the vertical leg 46 thereof to extend toward the interior of the shelf 22 and form a ledge or sill to support the end of the slat 40 as shown in FIG. 3A.

The generally L-shaped slat **40*a* is shown in FIG. 3A with an upright vertical leg 52*a* attached to a lower generally horizontal leg 54*a*. The slat horizontal leg 54*a* rests upon the crossbar horizontal leg 50 and is supported thereby. A tab or projection 56 extends axially proximate the upper edge of the generally vertical slat leg 52*a*. A bump out 58 or other appropriately configured mechanism is also provided on the vertical leg 52*a* of each slat 40*a* for the insertion of one of the legs 60 of a generally U-shaped bumper wire 62**.

Figure 3B:
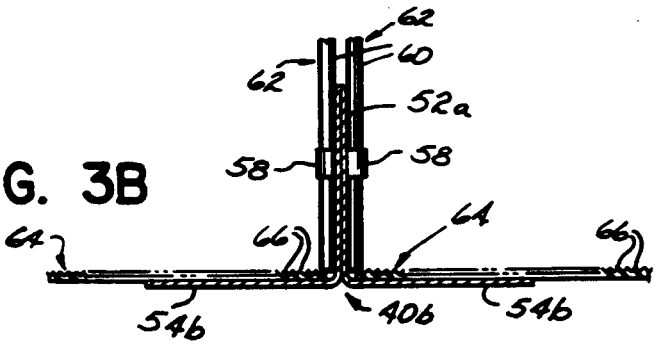
FIG. 3B is an enlarged cross-sectional view taken along lines 3B showing a T-shaped slat configuration of this invention.

In an alternative configuration, the slat **40*b* is constructed in a generally inverted T-shaped configuration as shown in FIG. 3B. The slat 40*b* has a generally vertical upstanding leg 52*b* projecting perpendicularly from the approximate centerline of a generally horizontal lower leg 54*b*. The T-shaped slat 40*b* is useful to form adjacent channels 42. In other words, a pair of adjacent channels can be formed from three slats 40 in which at least the center slat is of the T-shaped configuration. As a result, the horizontal leg 54*b* of the T-shaped slat 40*b* supports merchandise on each side of the generally vertical leg 52*b*. A bump out 58 or other device is provided on each face the vertical leg 52*b* for the insertion of one of the legs 60 of the bumper wire 62 at the front end of the slat 40*b***.

The width of each channel 42 can be advantageously adjusted depending on the particular merchandise items contained therein. For example, if the 12-pack 12 of beverage cans as shown in FIG. 2 is provided in the channel 42, the slats 40 cooperating to form the channel 42 are spaced further apart than the channel used for supporting single columns of individual cans 16 or bottles 14. A given shelf can be reconfigured for a variety of different merchandise items on the same shelf, each merchandise item having different widths. As a result, the retailer has much greater flexibility in designing merchandise displays and in configuring shelving systems with the present invention.

An additional feature of the shelving system 10 of this invention is the provision of a slip surface track 64 within each channel 42 as shown in FIGS. 2 and 3B. The slip surface track 64 consists essentially of a rectangular sheet of plastic having a generally planar bottom surface and a plurality of parallel spaced ribs 66 projecting upwardly from an upper surface thereof. The slip surface track 64 is inserted into the channel 42 between the vertical legs 52 on adjacent slats 40. The horizontal legs 50 on the crossbars 36, 38 and the horizontal legs 54 on the adjacent slats 40 support the slip surface track 64. The slip surface track 64 is useful for adding additional support to the merchandise items thereon and providing a reduced friction surface to promote the gravity feed advance of the merchandise items within the channel 42. Each upstanding rib 66 has a generally triangular shaped cross-sectional profile as is well known by one of ordinary skill in the art. In addition, a silicone additive or coating is preferably included in the slip surface track 64 to reduce the friction between the track 64 and the merchandise items thereon.

From the above disclosure of the general principles of the present invention and the preceding detailed description of a preferred embodiment, those skilled in the art will readily comprehend the various modifications to which the present invention is susceptible. For example, although this invention has been shown and described with reference to a gondola-type display rack, it is readily applicable for use with a rack-type display in which the front crossbar extends between adjacent front support posts and the rear crossbar extends between adjacent rear support posts. Such a display rack is shown and described in U.S. Pat. No. 5,160,051 assigned to the assignee of this invention and hereby incorporated by reference.

Furthermore, the specific configuration of the crossbars, slats, slots, tabs, and other components of this invention are exemplary only and can be readily modified within the scope of this invention by those of ordinary skill in the art. Therefore, we desire to be limited only by the scope of the following claims and equivalents thereof.

We claim:

1. A gravity feed shelving system for displaying merchandise supported thereon, said system comprising:

a support frame;

a plurality of shelves supported on said frame, said shelves being supported in a gravity feed configuration in which a front edge of each said shelf is lower than a rear edge thereof so that merchandise being supported on said shelves advances toward said front edge as a result of said gravity feed configuration;

a front and a rear crossbar on each said shelf, at least one of said crossbars having a plurality of apertures;

a plurality of slats on each said shelf, each said slat extending between said rear and said front crossbars, each said slat having a tab projecting axially proximate an upper edge at an end of said slat corresponding to said crossbar having said apertures therein, said tab being selectively engageable and disengageable with said apertures; and a channel being formed by a pair of adjacent said slats, each said channel supporting and arranging merchandise therein to form a column on said shelf, each said channel being selectively adjustable to a have a variety of widths depending upon which of said apertures said projection engages.

2. The system of claim 1 wherein said support frame is a gondola type frame in which said shelves are supported in a cantilever configuration.

3. The system of claim 1 wherein said support frame is a rack type frame wherein said front edge of each said shelf is supported by a plurality front posts and said rear edge of each said shelf is supported by a plurality of rear posts.

4. The system of claim 1 wherein some of said slats have an L-shaped configuration with a generally horizontal leg of said L-shaped slat underlying and supporting said column of merchandise.

5. The system of claim 1 wherein some of said slats have an inverted T-shaped configuration with a generally horizontal leg of said T-shaped slat underlying and supporting adjacent columns of merchandise.

6. The system of claim 1 wherein said apertures are slots formed in an upper edge of said crossbar.

7. The system of claim 1 wherein said crossbars have a generally L-shaped configuration with a flange depending from an upper edge of a generally vertical leg of said L-shaped crossbar, said apertures being slots formed in an upper edge of said flange and said generally vertical leg.

8. The system of claim 1 further comprising:

a slip surface track positioned between said adjacent slats in said channel, said slip surface track having a plurality of spaced, generally parallel ribs projecting upwardly from an upper surface thereof, said slip surface track providing reduced friction between said channel and the merchandise for gravity feed advancement of the merchandise on said shelf.

9. The system of claim 1 further comprising:

a bumper wire attached proximate said front edge of said shelf to retain the merchandise thereon.

10. The system of claim 9 wherein said bumper wire is in an inverted generally U-shaped configuration with a pair of downwardly projecting legs, each said leg being inserted into a hole in one of said adjacent slats.

11. A gravity feed gondola type shelving system for displaying merchandise supported thereon, said system comprising:

a floor mounted base;

a rear support frame extending upwardly from a rear of said base;

a plurality of shelves being attached in a cantilever configuration to said rear support frame, said shelves being in a gravity feed configuration in which a front edge of each said shelf is lower than a rear edge thereof so that merchandise being supported on said shelves advances toward said front edge as a result of said gravity feed configuration;

a front and a rear crossbar on each said shelf, at least one of said crossbars having a plurality of apertures; and a plurality of slats on each said shelf, each said slat extending between said rear and said front crossbars, each said slat having a tab projecting axially proximate an upper edge at an end of said slat corresponding to said crossbar having said apertures therein, said tab being selectively engageable and disengageable with said apertures;

a channel being formed by a pair of adjacent said slats, each said channel supporting and arranging merchandise therein to form a column on said shelf, each said channel being selectively adjustable to a have a variety of widths depending upon which of said apertures said projection engages.

12. The system of claim 11 wherein some of said slats have an L-shaped configuration with a generally horizontal leg of said L-shaped slat underlying and supporting said column of merchandise.

13. The system of claim 11 wherein some of said slats have an inverted T-shaped configuration with a generally horizontal leg of said T-shaped slat underlying and supporting adjacent columns of merchandise.

14. The system of claim 11 wherein said apertures are slots formed in an upper edge of said crossbar.

15. The system of claim 11 wherein said crossbars have a generally L-shaped configuration with a flange depending from an upper edge of a generally vertical leg of said L-shaped crossbar, said apertures being slots formed in an upper edge of said flange and said generally vertical leg.

16. The system of claim 11 further comprising:

a slip surface track positioned between said adjacent slats in said channel, said slip surface track having a plurality of spaced, generally parallel ribs projecting upwardly from an upper surface thereof, said slip surface track providing reduced friction between said channel and the merchandise for gravity feed advancement of the merchandise on said shelf.

17. The system of claim 11 further comprising:

a bumper wire attached proximate said front edge of said shelf to retain the merchandise thereon.

18. The system of claim 17 wherein said bumper wire is in an inverted generally U-shaped configuration with a pair of downwardly projecting legs, each said leg being inserted into a hole in one of said adjacent slats.

19. A gravity feed gondola type shelving system for displaying merchandise supported thereon, said system comprising:

a floor mounted base;

a rear support frame extending upwardly from a rear of said base;

a plurality of shelves being attached in a cantilever configuration to said rear support frame, said shelves being in a gravity feed configuration in which a front edge of each said shelf is lower than a rear edge thereof so that merchandise being supported on said shelves advances toward said front edge as a result of said gravity feed configuration;

a front and a rear crossbar on each said shelf, each said crossbar having a generally L-shaped configuration with a flange depending from an upper edge of a generally vertical leg of said L-shaped crossbar;

a plurality of slots formed in said upper edge of said flange and said generally vertical leg of each said crossbar;

a plurality of slats on each said shelf, each said slat extending between said rear and said front crossbars, each said slat having a tab at both a front and a rear end thereof, said front and rear tabs being selectively engageable and disengageable with said slots in said front and rear crossbars, respectively;

a channel being formed by a pair of adjacent said slats, each said channel supporting and arranging merchandise therein to form a column on said shelf, each said channel being selectively adjustable to a have a variety of widths depending upon which of said slots in said front crossbar said front tab engages and which of said slots in said rear crossbar said rear tab engages;

a slip surface track being positioned between said adjacent slats in said channel, said slip surface track having a plurality of spaced, generally parallel ribs projecting upwardly from an upper surface thereof, said slip surface track providing reduced friction between said channel and the merchandise for gravity feed advancement of the merchandise on said shelf; and a bumper wire having an inverted generally U-shaped configuration with a pair of downwardly projecting legs, each said leg being inserted into a hole in one of said adjacent slats, said bumper wire retaining the merchandise on said shelf.

* * * * *